US006858820B2

(12) United States Patent
Miura

(10) Patent No.: US 6,858,820 B2
(45) Date of Patent: Feb. 22, 2005

(54) FIXING DEVICE

(75) Inventor: Tatsuyuki Miura, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/456,567

(22) Filed: Jun. 9, 2003

(65) Prior Publication Data

US 2003/0230563 A1 Dec. 18, 2003

(30) Foreign Application Priority Data

Jun. 10, 2002 (JP) ..... 2002-169139

(51) Int. Cl.[7] ..... H05B 3/02
(52) U.S. Cl. ..... 219/476; 219/483; 399/330
(58) Field of Search ..... 219/216, 486, 219/485, 483, 497, 476; 399/44, 69, 330

(56) References Cited

U.S. PATENT DOCUMENTS 4,506,131 A * 3/1985 Boehm et al. ..... 219/662
4,585,325 A * 4/1986 Euler ..... 399/69
5,822,669 A * 10/1998 Okabayashi et al. ..... 399/330
5,839,043 A * 11/1998 Okabayashi et al. ..... 399/329
5,915,147 A * 6/1999 Kouno et al. ..... 399/69
6,091,052 A * 7/2000 Matsuo et al. ..... 219/216
6,233,412 B1 * 5/2001 Takahashi et al. ..... 399/69
6,288,370 B1 * 9/2001 Ogawa et al. ..... 219/469
6,316,754 B1 * 11/2001 Schatz et al. ..... 219/656
6,373,036 B2 * 4/2002 Suzuki ..... 219/619
6,463,252 B2 * 10/2002 Omoto et al. ..... 399/330
2001/0019678 A1 * 9/2001 Haneda et al. ..... 399/333
2002/0006296 A1 * 1/2002 Omoto et al. ..... 399/330
2002/0023920 A1 * 2/2002 Abe et al. ..... 219/619
2002/0048472 A1 * 4/2002 Samei ..... 399/328
2002/0067928 A1 * 6/2002 Nakayama ..... 399/69
2002/0150412 A1 * 10/2002 Nakayama ..... 399/330
2003/0053812 A1 * 3/2003 Nakayama ..... 399/44

FOREIGN PATENT DOCUMENTS

JP 10-31389 A 2/1998
JP 2001-185338 A 7/2001

* cited by examiner

*Primary Examiner*—Robin O. Evans
*Assistant Examiner*—Leonid M Fastovsky
(74) *Attorney, Agent, or Firm*—Foley & Lardner LLP

(57) ABSTRACT

Preset electric powers are distributed and continuously supplied to a plurality of coils to uniformly heat a fixing member in a warm-up period, and the preset electric power is supplied only to the coil corresponding to a region whose temperature is lowered in a ready state.

9 Claims, 4 Drawing Sheets

FIXING DEVICE

CROSS-REFERENCE TO RELATED APPLICATIONS

This application is based upon and claims the benefit of priority from the prior Japanese Patent Application No. 2002-169139, filed Jun. 10, 2002, the entire contents of which are incorporated herein by reference.

BACKGROUND OF THE INVENTION

1. Field of the Invention

This invention relates to a fixing device which heats and fixes a toner image formed on paper used as an image forming medium on the paper and an image forming apparatus having the fixing device and having a function of a copier, printer, facsimile machine and the like.

2. Description of the Related Art

For example, a fixing device which heats a toner image formed on an image forming medium such as film or paper to fix the toner image on the image forming medium is provided in some of electrophotographic copier, printers, facsimile machines and the like. Among the fixing devices used in the electro-photographic copiers, a fixing device having a heater described in Jpn. Pat. Appln. KOKAI Publication No. 2001-185338 is provided. The heater of the fixing device described in Jpn. Pat. Appln. KOKAI Publication No. 2001-185338 is divided into a plurality of systems. Further, in the fixing device described in Jpn. Pat. Appln. KOKAI Publication No. 2001-185338, the operation of each system of the heater is controlled based on the size of the paper used as the image forming medium or the size of the toner image formed on the image forming medium.

BRIEF SUMMARY OF THE INVENTION

An object of this invention is to provide a fixing device which effectively controls a heater divided into a plurality of systems, an image forming apparatus having the fixing device and a fixing device controlling method.

A fixing device which fixes toner on an image forming medium according to one aspect of this invention comprises a fixing member which heats and fixes a toner image formed on the image forming medium on the image forming medium, a heater divided into a plurality of systems and used to heat a plurality of divided regions of the fixing member, and a control section which causes preset electric power to be distributed and continuously supplied to the systems of the heater in a warm-up period in which the temperature of the fixing member is raised to a fixing temperature and causes the preset electric power to be supplied only to at least one selected system among the systems of the heater in a ready state in which the temperature of the fixing member is maintained.

An image forming apparatus which forms an image on an image forming medium according to another aspect of this invention comprises a toner image forming section which forms a toner image on the image forming medium, a fixing member which heats and fixes the toner image formed on the image forming medium by the toner image forming section on the image forming medium, a heater divided into a plurality of systems and used to heat a plurality of divided regions of the fixing member, and a control section which causes preset electric power to be distributed and continuously supplied to the systems of the heater in a warm-up period in which the temperature of the fixing member is raised to a fixing temperature and causes the preset electric power to be supplied only to at least one selected system among the systems of the heater in a ready state in which the temperature of the fixing member is maintained.

A fixing device controlling method according to still another aspect of this invention which is a method used for a fixing device including a fixing member which heats and fixes a toner image formed on an image forming medium on the image forming medium and a heater divided into a plurality of systems which heat a plurality of divided regions of the fixing member comprises distributing preset electric powers to the respective systems of the heater and setting warm-up electric powers of the respective systems when a warm-up period in which the temperature of the fixing member is raised to a fixing temperature is started, continuously supplying the warm-up electric powers to the respective systems of the heater during the warm-up period, and supplying the preset electric power only to at least one selected system among the systems of the heater in a ready state in which the temperature of the fixing member is maintained at the fixing temperature.

DETAILED DESCRIPTION OF THE INVENTION

There will now be described an embodiment of this invention with reference to the accompanying drawings.

Before explaining this invention, it is assumed that the short sides of A4R paper and A3 paper are defined as the width directions of the respective papers. Further, it is assumed that the long sides of A4R paper and A3 paper are defined as the lengthwise directions of the respective papers.

Figure 1:
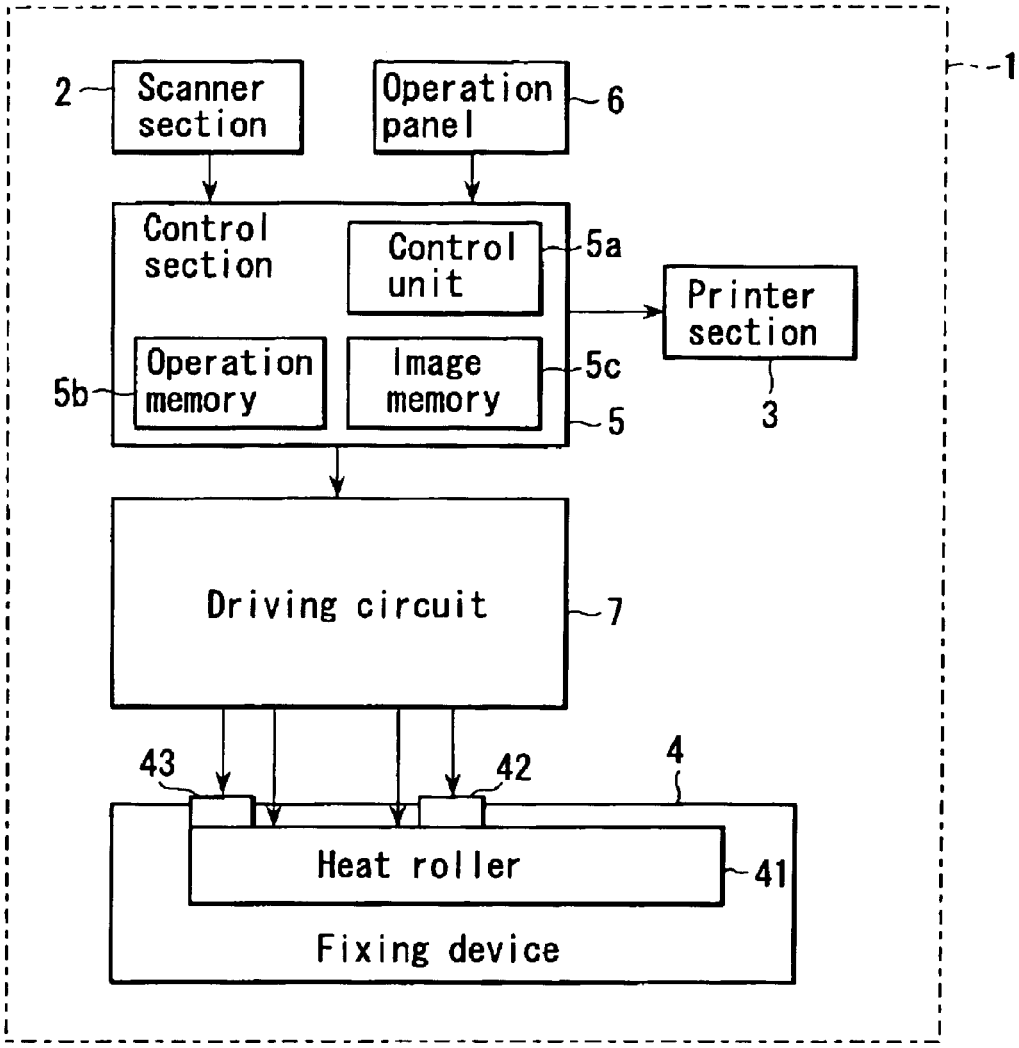
FIG. 1 is a block diagram showing a copier.

FIG. 1 is a block diagram showing the schematic configuration of a copier 1 used as an image forming apparatus according to this embodiment. As shown in FIG. 1, the copier 1 includes a scanner section 2, printer section 3, fixing device 4, control section 5, operation panel 6, driving circuit 7 and the like. It is assumed that the copier 1 of this embodiment can print an image or data on paper with the A4R width or A3 width.

The scanner section 2 optically reads an image of an original. The printer section 3 forms a toner image on paper used as an image forming medium. For example, the printer section 3 forms a toner image corresponding to an image read by the scanner section 2 on paper.

The fixing device 4 heats and fixes the toner image formed on the paper by the printer section 3 on the paper. The fixing device 4 includes a heat roller 41, central portion temperature sensor 42, end portion temperature sensor 43 and the like. The configuration of the fixing device 4 is explained in detail later.

The control section 5 controls the whole portion of the copier 1. For example, the control section 5 has functions of supplying operation commands to the respective portions of the copier 1, acquiring information from the respective portions of the copier 1 and processing information acquired from the respective portions of the copier. Further, the control section 5 includes a control unit 5*a*, operation memory 5*b*, image memory 5*c* and the like.

The control unit 5*a* is operated according to a control program stored in the operation memory 5*b* to control the operation of the respective portions of the copier 1.

In the operation memory 5*b*, the control program and control data which are required for the operation of the respective portions of the copier 1 are previously stored. Further, in the operation memory 5*b*, information input via the operation panel 6, information acquired from the respective portions of the copier 1, data which is now processed and the like are stored.

In the image memory 5*c*, an image of an original or the like read by the scanner section 2 is stored. Further, an image stored in the image memory 5*c* is supplied to the printer section 3 under control of the control unit 5*a*.

The control section 5 with the above configuration can rearrange the order of images stored in the image memory 5*c* and supply the images to the printer section 3 after the images of a plurality of originals are read by the scanner section 2 and temporarily stored into the image memory 5*c*.

The operation panel 6 is configured by an operating section to which a command is input from the user and a display section which displays guidance such as operation guidance. A command input by the operation panel 6 is supplied to the control section 5.

The driving circuit 7 is a circuit which supplies electric power to the fixing device 4. The driving circuit 7 supplies electric power to the fixing device 4 based on the operation control of the control section 5.

Next, the configuration of the fixing device 4 is explained.

Figure 2:
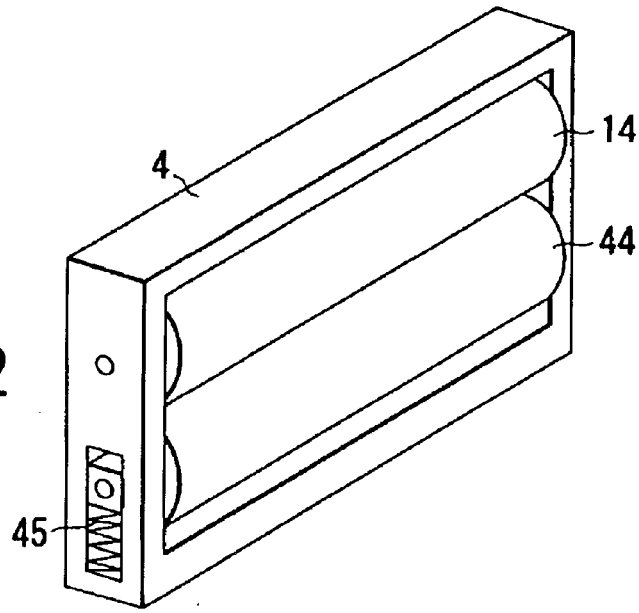
FIG. 2 is a schematic perspective view showing a fixing device.
Figure 3:
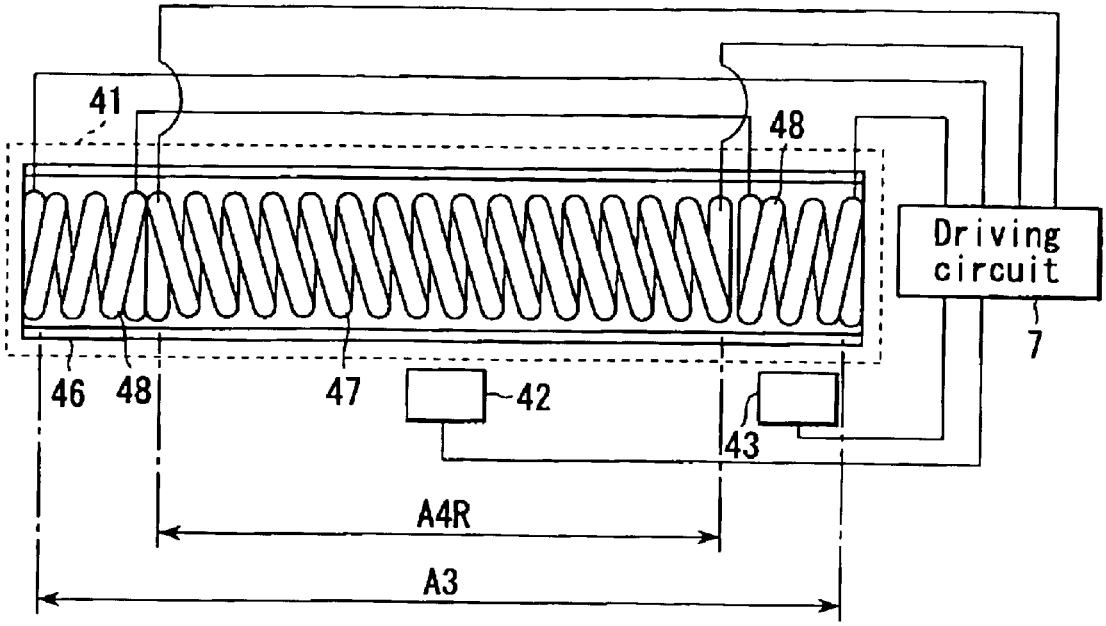
FIG. 3 is a cross-sectional view schematically showing a heat roller.

FIG. 2 is a perspective view schematically showing the configuration of the fixing device 4. FIG. 3 is a cross-sectional view schematically showing the configuration in the fixing device 4. As shown in FIG. 2, the fixing device 4 includes a heat roller 41 and a press roller 44 which is pressed against the heat roller 44 by use of a spring 45.

As shown in FIG. 3, the heat roller 41 includes a sleeve 46 to which a thermal-separation resistant layer is attached. The sleeve 46 is a cylindrical member formed of a conductive material such as aluminum, stainless alloy or carbon steel. The thermal-separation resistant layer of the sleeve 46 is formed of fluoroplastic coated on the peripheral portion of the cylindrical member. The width of the cylindrical member which forms the sleeve 46 (the height of the cylindrical body) is set slightly longer than the width of A3 paper. The sleeve 46 is used as the fixing device which heats and fixes a toner image formed on paper.

In the sleeve 46, coils 47, 48 used as a heater which heats the sleeve 46 are arranged. The coils 47, 48 are arranged in the vicinity of the internal surface of the sleeve 46. Further, the coils 47, 48 are divided into plural systems corresponding to a central coil 47 and end coils 48, for example.

In this case, a portion corresponding to the A4R width with the central position of the sleeve 46 set as a center is defined as a central region. The central coil 47 is arranged in a position corresponding to the central region. The central coil 47 is used to heat the central region of the sleeve 46.

Further, regions other than the central region of the sleeve 46 (regions of the two end portions of the sleeve 46) are defined as the end regions. The end coils 48 are arranged in positions corresponding to the end regions. The end coils 48 are used to heat the end regions of the sleeve 46. That is, the end coils 48 are used to heat the both end portions of the sleeve 46 which the central coil 47 cannot heat.

The central coil 47 or end coils 48 are supplied with high frequency currents (electric powers) from the driving circuit 7. The central coil 47 or end coils 48 make a change in the high frequency magnetic field according to the high frequency currents supplied from the driving circuit 7. The sleeve 46 causes an induction current by a change in the magnetic field caused by the central coil 47 or end coils 48. The sleeve 46 generates Joule heat according to the induction current.

Therefore, if electric power is supplied to the central coil 47 by the driving circuit 7, the central region of the sleeve 46 is heated. Further, if electric power is supplied to the end coils 48 by the driving circuit 7, the end regions of the sleeve 46 are heated.

A central portion temperature sensor 42 is disposed near the central portion of the sleeve 46. An end portion temperature sensor 43 is disposed near the end portion of the sleeve 46. The central portion temperature sensor 42 is used to sense the temperature of a portion of the sleeve 46 near the central portion thereof. The end portion temperature sensor 43 is used to sense the temperature of a portion of the sleeve 46 near the end portion thereof.

The central portion temperature sensor 42 and end portion temperature sensor 43 supply temperature information items indicating sensed temperatures to the control section 5. The control section 5 controls an amount of electric power supplied from the driving circuit 7 to the central coil 47 based on temperature information sensed by the central portion temperature sensor 42. Further, the control section 5 controls an amount of electric power supplied to the end coils 48 based on temperature information sensed by the end portion temperature sensor 43.

The sleeve 46 heated as described above is rotated at a preset speed by the driving force of a driving motor (not shown) which is controlled by the control section 5. For example, the driving force of the driving motor controlled by the control section 5 is transmitted to the sleeve 46 via a transmission mechanism such as a gear (not shown). As a result, the sleeve 46 is rotated at a preset speed by the control section 5.

In the fixing device shown in FIG. 2, paper on which a toner image is developed is passed through a pressed portion between the heat roller 41 and the press roller 44. That is, the control section 5 permits paper on which a toner image is developed to pass through the pressed portion between the heat roller 41 and the press roller 44. As a result, the control section 5 causes the toner image of the paper to be fixed on the paper.

Further, in the fixing device shown in FIG. 3, paper is passed through the pressed portion between the heat roller 41 and the press roller 44 with the width direction of the paper set parallel to the heat roller 41. Further, the paper is passed through the pressed portion between the heat roller 41 and the press roller 44 with the central position of the sleeve 46 set as a reference position.

That is, the A4R paper is carried to pass along the central region of the sleeve 46 by use of the heat roller 41 and the press roller 44. Further, the A3 paper is carried to pass along the whole region of the sleeve 46 configured by the central region and end regions of the sleeve 46 by use of the heat roller 41 and the press roller 44.

Next, the temperature control operation of the heat roller 41 is explained.

The copier 1 has a sleep mode. The sleep mode is an operation mode in which supply of electric power to the central coil 47 and end coils 48 is interrupted for energy saving. For example, the copier is changed from the normal operation mode to the sleep mode when it has not been used for a preset period of time or in a time zone in which the frequency of usage thereof is extremely low.

In the normal operation mode, a state (ready state) in which the fixing process can be instantly performed is set. In the normal operation mode, the temperature of the sleeve 46 is kept at the fixing temperature TF which is a temperature to fix a toner image on paper. In the normal operation mode, electric power is supplied to the central coil 47 and end coils 48 in order to keep the temperature of the sleeve 46 at the fixing temperature TF.

In the sleep mode, no electric power is supplied to the central coil 47 and end coils 48. Therefore, in the sleep mode, the temperature of the sleeve 46 is lower than the fixing temperature TF. Like the case wherein the copier 1 starts to be operated, the warm-up (WU) operation of setting the temperature of the sleeve 46 at the fixing temperature TF is required when the copier is changed from the sleep mode to the normal operation mode.

In a case where the temperature of the sleeve 46 is lower than the fixing temperature TF when the copier is changed from the sleep mode to the normal operation mode or when the copier 1 starts to be operated, the control section 5 performs the warm-up operation. In the warm-up operation, the control section 5 controls supply of electric power to the central coil 47 and end coils 48 so as to set the temperature of the sleeve 46 to the fixing temperature TF.

In the following explanation, a period in which the warm-up operation is performed as described above is called a warm-up (WU) period.

The control process for the copier 1 is performed in a digital fashion. Therefore, the temperature control process of the heat roller 41 (the temperature control process of the sleeve 46) is also performed in a digital fashion. Thus, if the temperature control process of the heat roller is performed in a digital fashion, the control operation by the control section 5 can be simplified.

In the warm-up operation, it is necessary to uniformly heat the whole portion of the sleeve 46 in the warm-up period. This is because heat escapes from one of the central region and end region of the sleeve 46 which has reached the fixing temperature TF while the other region which does not reach the fixing temperature TF reaches the fixing temperature TF in a case wherein one of the central region and end region has reached the fixing temperature TF and the other region does not reach the fixing temperature. Therefore, in the warm-up period, the control section 5 is required to perform the control process so as to uniformly heat the whole portion of the sleeve 46.

Further, in the ready state (normal operation mode), it is necessary to keep the whole portion of the sleeve 46 at the fixing temperature TF. This is because it is preferable to set a state in which the fixing process can always be performed in the ready state.

However, in the ready state, the temperature distribution of the sleeve 46 is drastically changed in some cases. For example, when the toner image is fixed on paper in the fixing device 4, heat of the sleeve 46 is carried away by the paper and toner and, as a result, the temperature distribution of the sleeve 46 is drastically changed.

Therefore, when the temperature of the sleeve 46 is drastically changed in the ready state, the control section 5 is required to rapidly control the heating process so as to cope with the drastic temperature change.

In order to meet the above requirement, the control section 5 performs the following operations in the warm-up period and ready state.

In the warm-up period, it is important to uniformly heat the sleeve 46. Further, in the warm-up period, the temperature of the sleeve 46 is only raised. Therefore, in the warm-up period, the control section 5 distributes and continuously supplies available electric powers to the central coil 47 and end coils 48.

On the other hand, in the ready state, it is necessary to cope with the rapid temperature change of the sleeve 46. Therefore, in the ready state, in the ready state, the control section 5 supplies available electric power to one of the central coil 47 and end coil 48. That is, the control section 5 selects one of the central coil 47 and end coil 48 according to the temperature change and supplies electric power only to the selected coil (central coil 47 or end coil 48).

For example, in the ready state, the control section 5 alternately inputs an output signal of the central portion temperature sensor 42 which indicates the temperature of the central portion of the sleeve 46 and an output signal of the end portion temperature sensor 43 which indicates the temperature of the end portion of the sleeve 46 at preset time intervals. Thus, the control section 5 alternately monitors the temperature of the central portion of the sleeve 46 and the temperature of the end portion thereof. As the result of temperature monitoring, the control section 5 supplies electric power to the central coil 47 if the temperature of the central portion of the sleeve 46 is low and the control section 5 supplies electric power to the end coil 48 if the temperature of the end portion of the sleeve 46 is low.

That is, when an output signal of the central portion temperature sensor 42 is input in the ready state, the control section 5 determines whether or not the temperature of the central portion of the sleeve 46 is lower than the preset fixing temperature based on the output signal of the central portion temperature sensor 42. Based on the above determination, if it is detected that the temperature of the central portion of the sleeve 46 is lower than the preset fixing temperature, the control section 5 supplies available electric power only to the central coil 47. The control section 5 which supplies electric power to the central coil 47 interrupts supply of electric power to the central coil 47 when an output signal of the end portion temperature sensor 43 is input.

Therefore, when the temperature sensed by the central portion temperature sensor 42 is lower than the fixing temperature in the ready state, the control section 5 supplies available electric power only to the central coil 47 until an output signal of the end portion temperature sensor 43 is input (for a preset time).

Likewise, when an output signal of the end portion temperature sensor 43 is input in the ready state, the control section 5 determines whether or not the temperature of the end portion of the sleeve 46 is lower than the preset fixing temperature based on the output signal of the end portion temperature sensor 43. Based on the above determination, if it is detected that the temperature of the end portion of the sleeve 46 is lower than the preset fixing temperature, the control section 5 supplies available electric power only to the end coil 48. The control section 5 which supplies electric power to the end coil 48 interrupts supply of electric power to the end coil 48 when an output signal of the central portion temperature sensor 42 is input.

Therefore, when the temperature sensed by the end portion temperature sensor 43 is lower than the fixing temperature in the ready state, the control section 5 supplies available electric power only to the end coil 48 until an output signal of the central portion temperature sensor 42 is input (for a preset time).

Next, examples of the operations in the warm-up (WU) period and ready state are explained with reference to the flowcharts shown in FIGS. 4, 5 and 6.

Figure 4:
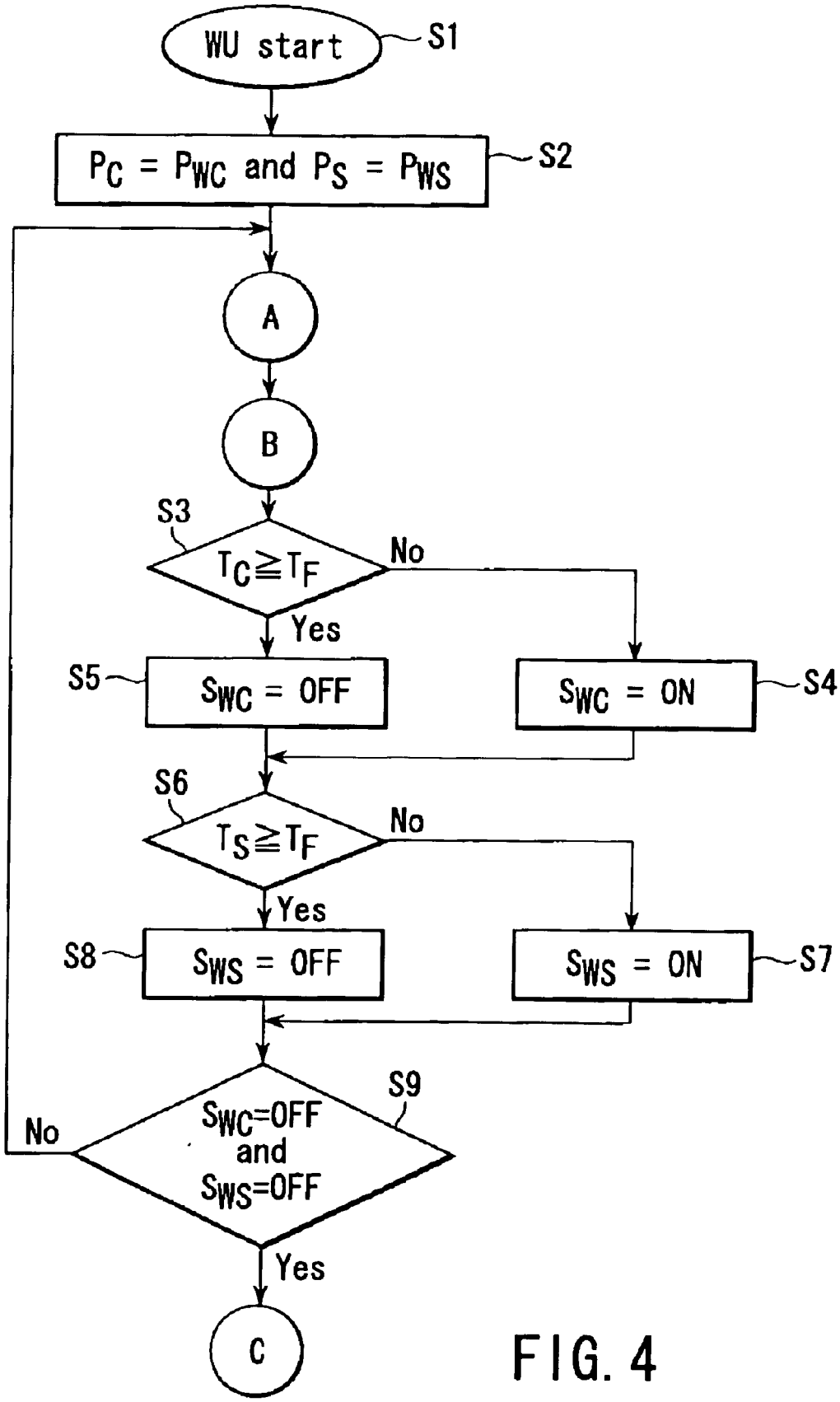
FIG. 4 is a flowchart for illustrating a temperature control process of a heat roller in a WU period.

FIG. 4 is a flowchart for illustrating a first operation example in the warm-up period.

First, the power supply of the whole portion of the copier 1 is turned OFF or in the sleep mode, the control section 5 is set in a state in which supply of electric power to the heat controller 41 is interrupted (in the rest state). If the power supply of the whole portion of the copier 1 is turned ON or start of the printing operation is specified in the reset state, the control section 5 starts the warm-up operation (S1) as described above.

When starting the warm-up operation, the control section 5 sets warm-up power Pwc as supply power to the central coil 47 and sets warm-up power Pws as supply power to the end coil 48 by use of the driving circuit 7 (S2). In this case, it is assumed that the supply power to the central coil 47 is set to electric power Pc and the supply power to the end coil 48 is set to electric power Ps. Then, the control section 5 sets the electric power Pc supplied to the central coil 47 to the warm-up power Pwc and sets the electric power Ps supplied to the end coil 48 to the warm-up power Pws at the starting time of the warm-up operation.

The sum of the electric powers Pc and Ps is set to electric power Pm. The electric power PM is electric power which can be supplied to the central coil 47 and end coil 48 used as the heater (electric power which can be used). The electric power PM may vary in some cases depending on electric power which the other constituent (a portion other than the heater) of the copier 1 uses.

In other words, the control section 5 divides the electric power Pm into the warm-up power Pwc and warm-up power Pws at the starting time of the warm-up operation. Then, the control section 5 sets the warm-up power Pwc to the electric power Pc which is supplied to the central coil 47 and sets the warm-up power Pws to the electric power Ps which is supplied to the end coil 48.

Further, in the warm-up period, it is preferable that the temperature of the whole portion of the sleeve 46 is uniformly raised and the temperatures of the central portion and end portion of the sleeve 46 will simultaneously reach the fixing temperature TF. In order to satisfy the above condition, a control method which will be explained below is used for the control process in the warm-up period.

For example, the control section 5 changes distribution amounts of the warm-up power Pwc supplied to the central coil 47 and the warm-up power Pws supplied to the end coil 48 based on the temperature of the central portion of the sleeve 46 sensed by the central portion temperature sensor 42 and the temperature of the end portion of the sleeve 46 sensed by the end portion temperature sensor 43. As a result, the control operation which can cope with a change in the actual temperature of the sleeve 46 can be performed.

The relation between the supply power and a temperature rise for each of the temperatures of the central portion and end portion of the sleeve 46 is previously and experimentally determined. The control section 5 may determine distribution amounts of the warm-up power Pwc supplied to the central coil 47 and the warm-up power PWS supplied to the end coil 48 based on the experimentally determined relation between the supply power and the temperature rise. In this case, the warm-up power PWC and warm-up power Pws are previously set. Therefore, the power control process performed by the control section 5 is simplified.

When the rising rates of the temperatures of the respective regions of the sleeve 46 with respect to the supply powers to the coils 47, 48 are substantially equal to each other, it is possible to equally distribute and supply the electric power Pm according to the ratio of the sizes of the coils 47, 48. For example, when the rising rate of the temperature Tc of the central portion of the sleeve 46 with respect to the supply power Pc to the central coil 47 is approximately equal to the rising rate of the temperature Ts of the end portion of the sleeve 46 with respect to the supply power Ps to the end coil 48, the control section 5 may supply powers obtained by equally distributing the electric power Pm according to the ratio of the sizes of the central coil 47 and end coil 48 to the respective coils. That is, in the heater having plural systems, if the temperature rising rates of the fixing member with respect to electric powers supplied to the respective systems are equal to one another, the control section 5 is only required to uniformly divide the electric power Pm by the number of systems configuring the heater and supply the electric powers to the respective systems. In this case, the control operation by the control section 5 and the configuration of the driving circuit 7 are made simple.

That is, the control section 5 continuously supplies the warm-up power Pwc and warm-up power Pws set as described above to the central coil 47 and end coil 48 in the warm-up period. As a result, the whole portion of the sleeve 46 can be uniformly heated.

Further, in the warm-up period, the control section 5 monitors the temperature Tc of the central portion of the sleeve 46 based on the sensing result of the central portion temperature sensor 42. Thus, the control section 5 determines whether or not the temperature Tc of the central portion of the sleeve 46 has reached the fixing temperature TF (S3).

If it is detected based on the above determination result that the temperature Tc of the central portion of the sleeve 46 has not reached the fixing temperature TF, the control section 5 sets the central coil 47 into an energized state (the conduction switch Swc of the central coil is set ON) (S4). As a result, electric power set as the supply power to the central coil 47 is supplied to the central coil 47. That is, when the warm-up power Pwc is set as the supply power to the central coil 47, the warm-up power Pwc is supplied to the central coil 47.

For example, if the central coil 47 is already set in the energized state (Swc=ON), the control section 5 maintains the energized state. If the central coil 47 is set in the cutoff state (Swc=OFF) in which no power is supplied to the central coil, the control section 5 sets the state of the central coil 47 into the energized state (Swc=ON) and supplies the set power to the coil.

If it is detected based on the above determination result that the temperature Tc of the central portion of the sleeve 46 has reached the fixing temperature TF, the control section 5 sets the central coil 47 into the cutoff state (Swc=OFF) (S5). As a result, supply of electric power to the central coil 47 is interrupted.

For example, when the central coil 47 is set in the energized state (Swc=ON) in which electric power is supplied thereto, the control section 5 changes the state of the central coil 47 into the cutoff state (Swc=OFF) to interrupt supply of power to the central coil 47. If the central coil 47 is set in the cutoff state (Swc=OFF) in which no electric power is supplied thereto, the control section 5 maintains the cutoff state. As a result, the temperature Tc of the central portion of the sleeve 46 is gradually lowered.

The control section 5 monitors the temperature TS of the end portion of the sleeve 46 based on the sensing result of the end portion temperature sensor 43. Thus, the control section 5 determines whether or not the temperature TS of the end portion of the sleeve 46 has reached the fixing temperature TF (S6).

If it is detected based on the above determination result that the temperature TS of the end portion of the sleeve 46 has not reached the fixing temperature TF, the control section 5 sets the end coil 48 into an energized state (the conduction switch Sws of the end coil is set ON) (S7). As a result, electric power set as the supply power to the end coil 48 is supplied to the end coil 48. That is, when the warm-up power Pws is set as the supply power to the end coil 48, the warm-up power Pws is supplied to the end coil 48.

For example, if the end coil 48 is already set in the energized state (Sws=ON), the control section 5 maintains the energized state of the end coil 48. If the end coil 48 is set in the cutoff state (Sws=OFF) in which no power is supplied to the end coil, the control section 5 sets the state of the end coil 48 into the energized state (Sws=ON) and supplies the set power to the coil.

If it is detected based on the above determination result that the temperature Ts of the end portion of the sleeve 46 has reached the fixing temperature TF, the control section 5 sets the end coil 48 into the cutoff state (Sws=OFF) (S8). As a result, supply of electric power to the end coil 48 is interrupted.

For example, when the end coil 48 is set in the energized state (Sws=ON) in which electric power is supplied thereto, the control section 5 changes the state of the end coil 48 into the cutoff state (Sws=OFF) to interrupt supply of power to the end coil 48. If the end coil 48 is set in the cutoff state (Sws=OFF) in which no electric power is supplied thereto, the control section 5 maintains the cutoff state. As a result, the temperature Ts of the end portion of the sleeve 46 is gradually lowered.

Further, the control section 5 determines whether or not both of the central coil 47 and the end coil 48 are set in the cutoff state (Swc=OFF and Sws=OFF) (S9).

If it is detected based on the above determination result that neither the central coil 47 nor the end coil 48 is set in the cutoff state, the control process is returned to the step S3 and the control section 5 repeatedly performs the process of the steps S3 to S9. Further, if it is determined that both of the central coil 47 and the end coil 48 are set in the cutoff state, the control section 5 terminates the warm-up operation and is set into the ready state.

Figure 5:
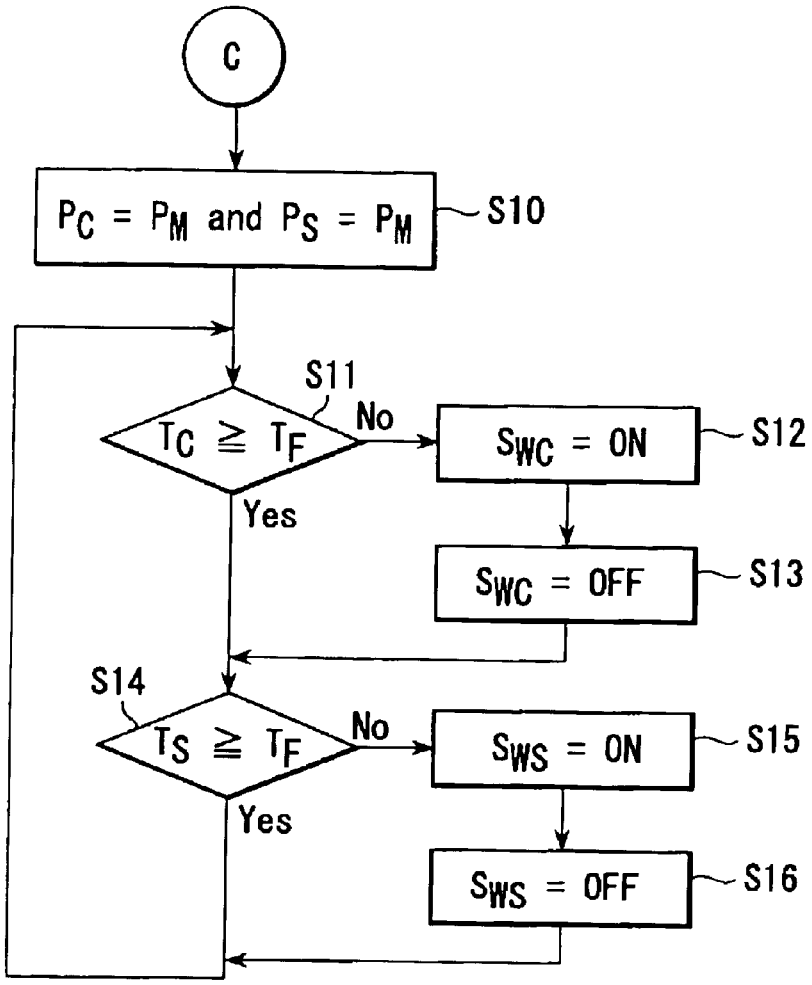
FIG. 5 is a flowchart for illustrating a temperature control process of the heat roller in a ready state.

FIG. 5 is a flowchart for illustrating an example of the control process in the ready state.

When the control section 5 is set into the ready state, it performs the control operation to alternately supply preset power Pm to the central coil 47 and end coil 48. The control section 5 sets electric power Pc supplied to the central coil 47 and electric power Ps supplied to the end coil 48 to the power Pm. Thus, the control section 5 is set into a state in which the preset power Pm is selectively supplied to one of the central coil 47 and end coil 48 (S10).

The control section 5 alternately fetches a sense signal of the central portion temperature sensor 42 and a sense signal of the end portion temperature sensor 43 at preset time intervals in the ready state. Thus, the control section 5 alternately detects the temperature Tc of the central portion of the sleeve 46 and the temperature Ts of the end portion thereof at preset time intervals.

When the control section 5 fetches a sense signal of the central portion temperature sensor 42 in this state, it determines whether or not the temperature Tc of the central portion of the sleeve 46 is lower than the fixing temperature TF (S11).

If it is detected based on the above determination result that the temperature Tc is lower than the fixing temperature TF, the control section 5 supplies the power Pm to the central coil 47 (S12). Therefore, the central coil 47 is set into the energized state (Swc=ON). When a preset time has elapsed after the central coil 47 was set into the energized state (when the sense signal from the end coil 48 is fetched), the control section 5 interrupts supply of electric power to the central coil 47 (S13). Thus, the central coil 47 is changed from the normal state into the cutoff state (Swc=OFF).

Further, if it is detected based on the above determination result that the temperature Tc is equal to or higher than the fixing temperature TF, the control section 5 maintains the central coil 47 in the cutoff state (Swc=OFF).

When a preset time has elapsed after the sense signal from the central portion temperature sensor 42 was fetched, the control section 5 fetches the sense signal from the end portion temperature sensor 43. That is, when a preset time has elapsed after the sense signal from the central portion temperature sensor 42 was fetched, the control section 5 senses the temperature Ts of the end portion of the sleeve 46 based on the sense signal fetched from the end portion temperature sensor 43. When the temperature Ts is sensed based on the sense signal from the end portion temperature sensor 43, the control section 5 determines whether or not the temperature Ts is lower than the fixing temperature TF (S14).

If it is detected based on the above determination result that the temperature Ts is lower than the fixing temperature TF, the control section 5 supplies the power Pm to the end coil 48 (S15). Therefore, the end coil 48 is set into the energized state (Sws=ON). When a preset time has elapsed after the end coil 48 was set into the energized state (when the sense signal from the central coil 47 is fetched again), the control section 5 interrupts supply of electric power to the end coil 48 (S16). Thus, the end coil 48 is changed from the normal state into the cutoff state (Sws=OFF).

Further, if it is detected based on the above determination result that the temperature Ts is equal to or higher than the fixing temperature TF, the control section 5 maintains the end coil 48 in the cutoff state (Sws=OFF).

The control section 5 repeatedly performs the process of the steps S11 to S16 in the ready state. Thus, in the ready state, the temperature of the whole portion of the sleeve 46 is controlled to be set at or near the fixing temperature TF.

As described above, according to the operation example shown in FIGS. 4 and 5, in the fixing device having the coil used as the heater and divided into plural systems, electric powers are distributed to the respective coil portions to uniformly heat the fixing member and the distributed electric powers are continuously supplied to the respective coils in the warm-up period. In the ready state, a region of the fixing member in which the temperature is lowered is monitored at preset time intervals and electric power is supplied only to the coil corresponding to the region in which the temperature is lowered.

Therefore, even in the fixing device having the coil used as the heater and divided into plural systems, the whole portion of the fixing member is uniformly heated in the warm-up period and a local portion of the fixing member in which the temperature is lowered can be rapidly heated in the ready state.

Next, the transition process in the warm-up period is explained.

Figure 6:
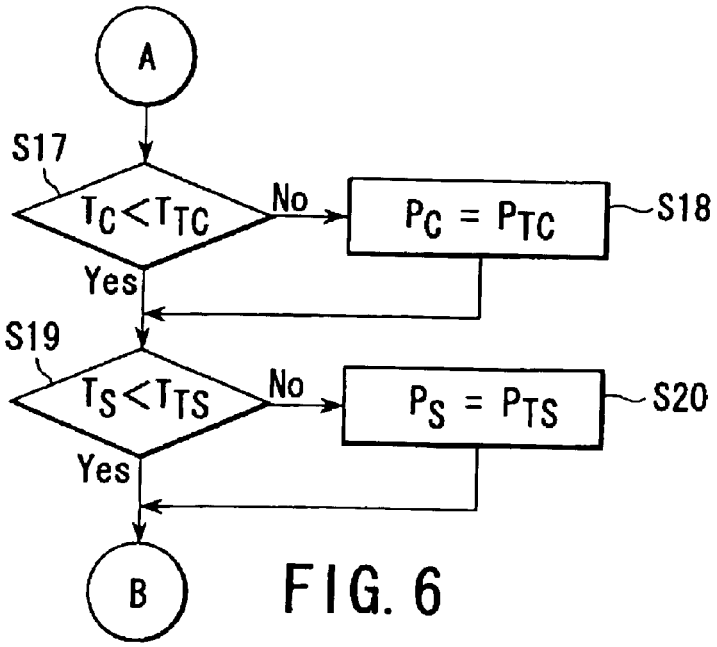
FIG. 6 is a flowchart for illustrating a transition process of the heat roller from the WU period to the ready state.

FIG. 6 is a flowchart for illustrating the transition process in the warm-up period.

The transition process is a process performed immediately before the warm-up period is terminated (immediately before the state transition to the ready state). For example, the transition process shown in FIG. 6 is performed between "A" and "B" shown in FIG. 4 in the warm-up process shown in FIG. 4.

The transition process is a process performed to prevent overshooting of the temperature of the sleeve 46 when the state transition from the warm-up period to the ready state. For example, when the warm-up operation is performed only by performing the process of the steps S1 to S9 shown in FIG. 4, a phenomenon (overshooting) that the temperature of the sleeve 46 exceeds a preset permissible range when the state transition from the warm-up period to the ready state may occur. The overshooting means that the temperature of the sleeve 46 becomes higher than a preset temperature (fixing temperature TF). Generally, there occurs no problem when the overshooting is set within a preset permissible range, but there occurs a problem in the safety in some cases when it exceeds the preset permissible range. Particularly, when the power Pm distributed to each of the coils 47, 48 is high, the degree of overshooting tends to become large.

Next, an example of the transition process in the warm-up period is explained in detail with reference to FIG. 6.

First, it is determined in the step S9 of FIG. 4 that the state of "Swc=OFF" and "Sws=OFF" is not set (at least one of the coils 47, 48 is set in the energized state), the control section 5 determines that the warm-up period is not terminated. When determining that the warm-up period is not terminated ("NO" in the step S9), the control section 5 performs the transition process of the steps S17 to S20 of FIG. 6.

In the above transition process, first, the control section 5 determines whether or not the temperature Tc of the central portion of the sleeve 46 has reached a central portion transition temperature Ttc based on the result of sensing by the central portion temperature sensor 42 (S17).

In this case, the central portion transition temperature Ttc indicates a temperature used to determine whether the transition process is performed with respect to the central coil 47.

When it is determined that the temperature Tc of the central portion of the sleeve 46 has reached the central portion transition temperature Ttc ("YES" in the step S17), the control section 5 switches the set value of the power Pc supplied to the central coil 47 from warm-up power Pwc of the central portion to central portion transition power Ptc (S18). The central portion transition power Ptc is power which is lower than the warm-up power Pwc of the central portion. When the set value of the power Pc supplied to the central coil 47 is switched to the central portion transition power Ptc, the control section 5 continuously supplies the central portion transition power Ptc to the central coil 47 until it is determined in the step S3 of FIG. 4 that the temperature Tc becomes equal to or higher than the fixing temperature TF.

Therefore, in the warm-up period, the central portion transition power Ptc set in the step S18 of FIG. 6 is continuously supplied to the central coil 47 in a period in which the temperature Tc is changed from the central portion transition temperature Ttc and reaches the fixing temperature TF. Further, in the warm-up period, the warm-up power Pwc of the central portion set in the step S2 of FIG. 4 is continuously supplied to the central coil 47 in a period in which the temperature Tc is equal to or lower than the central portion transition temperature Ttc. Therefore, in the warm-up period, the temperature Tc of the central portion of the sleeve 46 continuously rises.

However, the central portion transition power Ptc is lower than the warm-up power Pwc. Therefore, when the warm-up period is terminated and the state is set into the ready state, the amount of overshooting of the temperature occurring in the central portion of the sleeve 46 becomes small. That is, the central portion transition power Ptc is set to such a value that the amount of overshooting of the temperature occurring in the central portion of the sleeve 46 will be set within a permissible range when the warm-up period is terminated and the state is set into the ready state (when the temperature Tc has reached the fixing temperature TF).

For supply of power to the end coil 48, the same transition process as that for supply of power to the central coil 47 is performed.

That is, the control section 5 determines whether or not the temperature Ts of the end portion of the sleeve 46 has reached an end portion transition temperature Tts based on the result of sensing by the end portion temperature sensor 43 (S19).

In this case, the end portion transition temperature Tts indicates a temperature used to determine whether the transition process is performed with respect to the end coil 48.

When it is determined that the temperature Ts of the end portion of the sleeve 46 has reached the end portion transition temperature Tts ("NO" in the step S19), the control section 5 switches the set value of the power Ps supplied to the end coil 48 from warm-up power Pws of the end portion to end portion transition power Pts (S20). The end portion transition power Pts is power which is lower than the warm-up power Pws of the end portion. When the set value of the power Ps supplied to the end coil 48 is switched to the end portion transition power Pts, the control section 5 continuously supplies the end portion transition power Pts to the end coil 48 until it is determined in the step S6 of FIG. 4 that the temperature Ts is equal to or higher than the fixing temperature TF.

Therefore, in the warm-up period, the end portion transition power Pts set in the step S20 of FIG. 6 is continuously supplied to the end coil 48 in a period in which the temperature Ts is changed from the end portion transition temperature Tts and reaches the fixing temperature TF. Further, in the warm-up period, the warm-up power Pws of the end portion set in the step S2 of FIG. 4 is continuously supplied to the end coil 48 in a period in which the temperature Ts is equal to or lower than the end portion transition temperature Tts. Therefore, in the warm-up period, the temperature Ts of the end portion of the sleeve 46 continuously rises.

However, the end portion transition power Pts is lower than the warm-up power Pws. Therefore, when the warm-up period is terminated and the state is set into the ready state, the amount of overshooting of the temperature occurring in the end portion of the sleeve 46 becomes small. That is, the end portion transition power Pts is set to such a value that the amount of overshooting of the temperature occurring in the end portion of the sleeve 46 will be set within a permissible range when the warm-up period is terminated and the state is set into the ready state (when the temperature Ts has reached the fixing temperature TF).

That is, in the warm-up period containing a period of the above transition process, the electric power supplied to the central coil 47 is controlled as follows.

When the temperature Tc of the central portion of the sleeve 46 is set to satisfy the relation of $Tc \leqq Ttc$, that is, in a period in which the warm-up process is started and the temperature Tc reaches the transition temperature Ttc, the control section 5 supplies the power Pwc to the central coil 47. Further, when the temperature Tc of the central portion of the sleeve 46 is set to satisfy the relation of $Ttc < Tc \leqq TF$, that is, in a period from the time the temperature Tc has reached the transition temperature Ttc to the time it reaches the fixing temperature TF, the control section 5 supplies the central portion transition power Ptc ($Ptc < Pwc$) to the central coil 47.

Further, in the warm-up period containing a period of the above transition process, the electric power supplied to the end coil 48 is controlled as follows.

When the temperature Ts of the end portion of the sleeve 46 is set to satisfy the relation of $Ts \leqq Tts$, that is, in a period in which the warm-up process is started and the temperature Ts reaches the transition temperature Tts, the control section 5 supplies the power Pws to the end coil 48. Further, when the temperature Ts of the end portion of the sleeve 46 is set to satisfy the relation of $Tts < Ts \leqq TF$, that is, in a period from the time the temperature Ts has reached the transition temperature Tts to the time it reaches the fixing temperature TF, the control section 5 supplies the end portion transition power Pts ($Pts < Pws$) to the end coil 48.

As described above, in the transition process, if the temperature Tc of the central portion of the sleeve 46 is set near the fixing temperature TF, the power Pc supplied to the central coil 47 is switched to the transition power Ptc lower than the warm-up power Pwc which has been supplied so far. Further, if the temperature Ts of the end portion of the sleeve 46 is set near the fixing temperature TF, the power (Ps) supplied to the end coil 48 is switched to the transition power Pts lower than the warm-up power Pws which has been supplied so far.

As a result, occurrence of the overshooting of the temperature of the sleeve when the state transition to the ready state can be prevented. Further, by setting the overshooting amount within the permissible range at the time of transition to the ready state, the normal toner image fixing process can be performed without damaging paper and causing a phenomenon that the toner image is excessively fixed even if the fixing process is performed immediately after the temperature of the sleeve 46 reaches the fixing temperature TF (immediately after transition to the ready state).

In the present embodiment, as shown in FIG. 3, the dimensions of the sleeve 46 of the heat roller 41 or the dimensions of the central coil 47 and end coils 48 are explained with the width of A4R or A3 paper used as a reference. However, the dimensions of the sleeve 46, central coil 47 and end coils 48 may be designed while the maximum width of paper which can be printed by the copier 1 is used as a reference. In this case, the same control method as that explained above can be used.

For example, the sleeve 46 is set larger than the maximum width of paper which can be printed by the copier 1. Further, the end coil 48 is not necessarily required to heat the remaining entire portion of the sleeve 46 other than the central portion and is sufficient if it can cope with paper of the maximum width which can be printed by the copier 1. The central coil 47 is formed with the size corresponding to the size of a post card if it copes with paper having the size of a post card. Further, in order to cope with paper having different paper width, an additional coil which heats a portion which cannot be heated only by use of the central coil 47 may be provided. In order to cope with paper having still larger paper width, a further additional coil which heats a portion which cannot be heated only by use of the central coil 47 and additional coil may be provided. Thus, the number of heater systems can be increased.

In the above embodiment, a case wherein the fixing device using an IH (induction heater) heating system like the central coil 47 and end coils 48 is used is explained. However, the heating system is not limited to the IH heating system and a heater using another heating system can be used. In this case, the above control process can be performed by dividing the heater into a plurality of systems.

Further, in the above embodiment, as shown in FIG. 3, the fixing device with the configuration in which the central portion of paper is passed through the center of the pressed portion between the heat roller 41 and the press roller 44 is explained. However, the configuration of the fixing device is not limited to the above configuration, and as shown in an example of a heat roller 141 shown in FIG. 7, a fixing device with the configuration in which the end portion of paper is passed through the end portion of a sleeve 146 can be used. As shown in an example of the configuration of FIG. 7, the heat roller 141 has such a configuration that a first coil 147 used to heat a portion of the sleeve 146 which fixes paper having the small width is arranged on the end portion side and a second coil 148 is used to cope with a portion thereof which cannot be heated by the first coil 146. In the example of the configuration shown in FIG. 7, a temperature sensor 142 used as the configuration corresponding to the central portion temperature sensor 42 and a temperature sensor 143 used as the configuration corresponding to the end portion temperature sensor 43 are provided.

Figure 7:
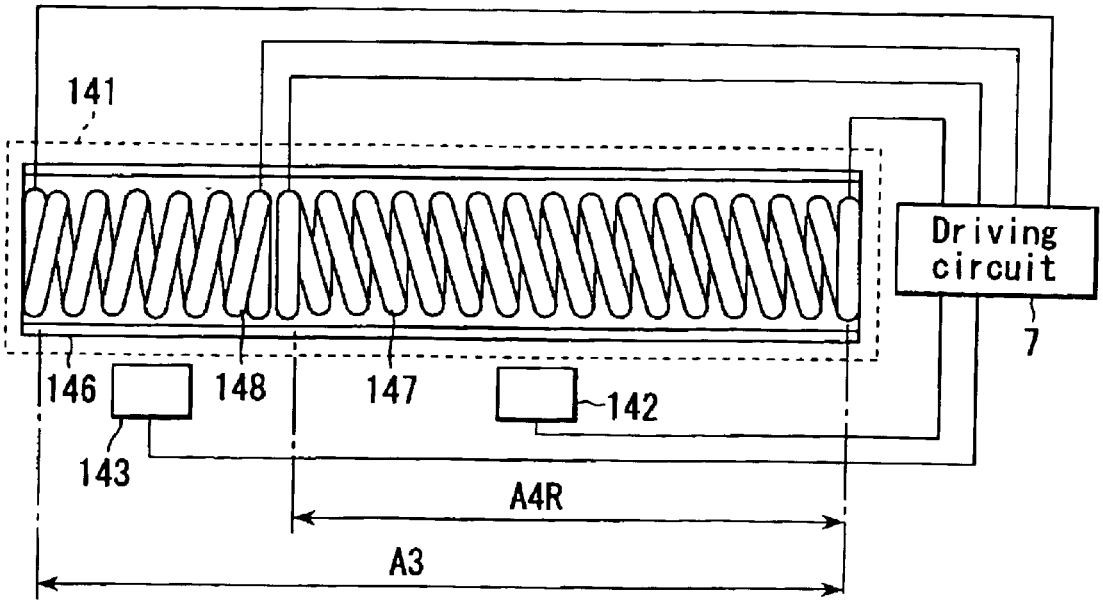
FIG. 7 is a cross-sectional view schematically showing the heat roller in a case wherein paper is passed along the end portion of the heat roller.

The heat roller 141 with the configuration shown in FIG. 7 is simple in configuration in comparison with the heat roller 41 with the configuration having the end coils 48 on both ends. Thus, the control method explained in the present embodiment can be applied to a fixing device having a heater divided into plural systems.

In the example of the configuration shown in FIG. 1, a case wherein the control section 5 and the driving circuit 7 are formed of different circuits is explained, but if they are formed as one unit, the circuit configuration can be made smaller.

Further, the present embodiment in which the fixing device is used in the copier is explained. However, the fixing device can be applied to an image forming apparatus such as a facsimile or printer which prints image data supplied from an external device on an image forming medium. Further, the fixing device can be used as a fixing device of a digital compound machine MFP (multi-function peripheral) having various functions such as a printer function, scanner function, network communication function and facsimile function.

As described above, according to the present embodiment, in a fixing device having a fixing member which heats and fixes a formed toner image on paper and a heater divided into plural systems and used to heat the fixing member, preset powers are distributed to the plural systems to continuously supply powers thereto in the warm-up period and the preset power is supplied to the plural systems by turns without being distributed thereto in the ready state.

Thus, even in the fixing device having the heater with the plural systems, the temperature control process and power control process for the fixing member can be effectively performed.

What is claimed is:

1. A fixing device which fixes toner on an image forming medium comprising:

a fixing member which heats and fixes a toner image formed on the image forming medium on the image forming medium, and which includes a conductive member that generates heat in response to an eddy current caused by changes in a magnetic field;

a first coil provided in correspondence to a first region of the fixing member and configured to provide the first region of the fixing member with changes in a magnetic field;

a second coil provided in correspondence to a second region of the fixing member and configured to provide the second region of the fixing member with changes in a magnetic field;

a first sensor configured to sense a temperature of the first region of the fixing member;

a second sensor configured to sense a temperature of the second region of the fixing member;

a control section which determines distribution amounts between first electric power to be supplied to the first coil and second electric power to be supplied to the second coil, on the basis of maximum applicable electric power, and which sets the first electric power and the second electric power on the basis of temperatures sensed by the first sensor and the second sensor in a warm-up period in which a temperature of the overall fixing member is raised to a fixing temperature, and a driving circuit which continually provides the first coil and the second coil with the first electric power and the second electric power which are set by the control section in the warm-up period.

2. The fixing device according to claim 1, wherein the control section reduces the first or second electric power to be supplied to the first or second coil immediately before the temperature of the first or second region of the fixing member heated by the first or second coil reaches the fixing temperature in the warm-up operation.

3. The fixing device according to claim 1, wherein the control section:

determines whether the temperature of the first or second region of the fixing member to be sensed by the first or second sensor, reaches a transition temperature which is lower than the fixing temperature;

sets electric power to be continuously supplied to the first or second coil as the first or second electric power until the temperature in the first or second region of the fixing member rises to the transition temperature; and changes electric power to be continuously supplied to the first or second coil to a transition electric power which is lower than the first or second electric power when the temperature of the first or second region of the fixing member has exceeded the transition temperature of the first or second region of the fixing member in a warm-up operation.

4. The fixing device according to claim 1, wherein the control section determines whether electric power should be supplied to the first coil or the second coil, alternately, at preset time intervals in the ready state; and an actuating circuit causes the maximum electric power to be supplied only to the first or second coil which is determined to be supplied with the maximum electric power by the control section.

5. The fixing device according to claim 1, wherein the control section determines whether the temperature of the first or second region of the fixing member is sensed to be not higher than a preset temperature, on the basis of the temperature to be sensed by the first or second sensor at preset time intervals in the ready state; and an actuating circuit causes the maximum electric power to be supplied only to the first or second coil which corresponds to the first or second region whose temperature is determined to be not higher than the preset temperature by the control section.

6. The fixing device according to claim 1, wherein the control section determines the electric power to be supplied to the first coil or the second coil so that the fixing member is uniformly heated.

7. The fixing device according to claim 1, wherein the first coil and the second coil are arranged end-to-end within the fixing member.

8. A fixing device which fixes toner on an image forming medium comprising:

a fixing member which heats and fixes a toner image formed on the image forming medium on the image forming medium;

a first coil provided in correspondence to a first region of the fixing member;

a second coil provided in correspondence to a second region of the fixing member;

a first sensor configured to sense a temperature of the first region of the fixing member;

a second sensor configured to sense a temperature of the second region of the fixing member;

a driving circuit that provides the first coil with a first electric power and the second coil with a second electric power; and a controller that determines a relative distribution of the first electric power to be supplied to the first coil and the second electric power to be supplied to the second coil, the relative distribution being based on a predetermined applicable electric power, and which sets the first electric power and the second electric power based on the respective temperatures sensed by the first sensor and the second sensor in a warm-up period during which a temperature of the fixing member is raised to a fixing temperature.

9. The fixing device according to claim 8, wherein the predetermined applicable electric power is a maximum applicable electric power.

* * * * *